US007350264B2

(12) United States Patent
Bedard et al.

(10) Patent No.: US 7,350,264 B2
(45) Date of Patent: Apr. 1, 2008

(54) MOBILE VACUUM SWEEPER

(75) Inventors: Marc Bedard, Ste-Julie (CA); Andre Dubois, Browsburg-Chatham (CA)

(73) Assignee: Madvac Inc., Longueuil, Quebec (CA)

( * ) Notice: Subject to any disclaimer, the term of this patent is extended or adjusted under 35 U.S.C. 154(b) by 597 days.

(21) Appl. No.: 10/702,349

(22) Filed: Nov. 6, 2003

(65) Prior Publication Data

US 2005/0097703 A1 May 12, 2005

(51) Int. Cl.
*E01H 1/05* (2006.01)
*E01H 1/08* (2006.01)

(52) U.S. Cl. ..... 15/340.3; 15/347

(58) Field of Classification Search ..... 15/347, 15/340.1, 340.2, 340.3, 340.4
See application file for complete search history.

(56) References Cited

U.S. PATENT DOCUMENTS

| | | | | |
|---|---|---|---|---|
| 2,973,544 | A * | 3/1961 | Romaniuk | 15/340.1 |
| 3,004,279 | A * | 10/1961 | Ringer | 15/346 |
| 3,105,991 | A * | 10/1963 | Oberg | 15/340.3 |
| 4,580,312 | A | 4/1986 | Raaij | |
| 4,831,684 | A * | 5/1989 | Duncan | 15/340.1 |
| 4,884,313 | A | 12/1989 | Zoni | |
| 5,058,235 | A | 10/1991 | Charky | |
| 5,768,744 | A * | 6/1998 | Hamilton | 15/340.1 |
| 6,041,471 | A | 3/2000 | Charky et al. | |
| 6,675,424 | B2 * | 1/2004 | Smith et al. | 15/340.4 |

FOREIGN PATENT DOCUMENTS

| | | | |
|---|---|---|---|
| CA | 1268306 | | 5/1990 |
| CA | 1296493 | | 3/1992 |
| DE | 41 28 988 | A1 | 3/1993 |
| DE | 296 13 858 | * | 10/1996 |
| EP | 1 164 074 | A | 12/2001 |
| FR | 2779455 | | 9/2000 |
| WO | WO 87/01404 | * | 3/1987 |
| WO | WO 87/01404 | A1 | 3/1987 |
| WO | WO 88/09848 | | 12/1988 |

* cited by examiner

*Primary Examiner*—Theresa T. Snider
(74) *Attorney, Agent, or Firm*—Tarolli, Sundheim, Covell & Tummino LLP

(57) ABSTRACT

A vacuum sweeper vehicle has a sweeper body including a frame. A pair of front wheels are supported by an axle apparatus at a forward end of the sweeper body. The axle apparatus is constructed to provide a space between the front wheels. A pair of rear wheels are supported at a rearward end of the sweeper body. A container is coupled to the sweeper body for receiving debris. A suction hose extends between the container and a vacuum nozzle proximal a forward end of the body. The suction hose extends through the space between the the front wheels. A suction device draws the debris from the nozzle, into the container, and a brush coupled to a forward end of the sweeper body sweeps debris from a ground surface.

34 Claims, 7 Drawing Sheets

MOBILE VACUUM SWEEPER

FIELD OF THE INVENTION

The present invention relates in general to street and walkway sweeping devices, and more particularly to a mobile vacuum sweeper for removing debris from roadways and sidewalks.

BACKGROUND OF THE INVENTION

Street sweeping vehicles conventionally include an operator's cab near a front of the vehicle, for an operator to drive the vehicle when in use. Typically, each vehicle includes sweeping brushes secured to the frame of the vehicle, near an intake nozzle of a suction hose so that debris from the surface, such as a roadway or walkway, is swept towards the intake nozzle and is drawn into the suction hose. Each vehicle also includes a debris container at an opposite end of the suction hose for receiving the debris that is drawn from the surface. Thus, the operator drives the sweeping vehicle along the surface while the brushes sweep and lift debris from the surface and the debris is drawn into the suction hose and deposited into the debris container.

Many variations of sweeping vehicles have been proposed for a variety of reasons. In some cases, the intake nozzle of the suction hose and the sweeping brushes are located under the cab, behind the cab, or towards the rear of the vehicle. One of the disadvantages of these arrangements is that the operator is unable to view the location of the brushes and nozzle and is unable to direct the vehicle accurately such that the brushes and nozzle pass directly over debris along the surface being cleaned. Also, the operator is unable to detect a possible blockage problem in the suction hose as the operator cannot see the intake nozzle to determine if the nozzle is drawing in debris.

In other sweeping vehicles, the intake nozzle and the sweeping brushes are located near or forward of the operator's cab. In these vehicles, the suction hose extends from the intake nozzle toward the front of the vehicle, to the debris container behind the operator's cab. Thus, the suction hose extends either in front of the front axle or behind the front axle. Both of these vehicle arrangements also suffer from several disadvantages, however. In the case that the suction hose is located in front of the front axle, the size of the operator's cab is reduced, reducing the space that the operator has when inside the cab, as the suction hose passes through this area. Alternatively, the front axle and front wheels are located closer to the rear of the vehicle to allow the suction hose to pass by without imposing on the space of the operator's cab. This is clearly not desirable, however, as the shorter wheelbase provides a less comfortable ride and less vehicle stability.

In the case that the suction hose is located behind the front axle, the suction hose passes under the axle and then bends upwardly. This is undesirable as the upward bend causes a point where blockage can occur. As is well known, it is desirable to ensure that the suction hose is relatively straight or free of any tight turns or bends to allow free flow of air and debris through the hose since tight turns or bends in the hose generally provide points where blockages occur.

Accordingly, it is an object of an aspect of the present invention to provide an improved mobile vacuum sweeper to obviate or mitigate at least some of the disadvantages of the prior art.

SUMMARY OF THE INVENTION

In one aspect of the present invention, there is provided a vacuum sweeper vehicle that has a sweeper body including a frame. A pair of front wheels are supported by an axle apparatus at a forward end of the sweeper body. The axle apparatus is constructed to provide a space between the front wheels. A pair of rear wheels are supported at a rearward end of the sweeper body. A container is coupled to the sweeper body for receiving debris. A suction hose extends between the container and a vacuum nozzle proximal a forward end of the body. The suction hose extends through the space between the front wheels. A suction device draws the debris from the nozzle, into the container, and a brush coupled to a forward end of the sweeper body sweeps debris from a ground surface.

In another aspect of the present invention, there is provided in a vacuum sweeper vehicle having a sweeper body, a container coupled to the sweeper body for receiving debris, a suction hose extending between a vacuum nozzle proximal a forward end of the body and the container, a suction device for drawing debris from the nozzle into the container, and at least one brush connected to a forward end of the sweeper for sweeping debris from a ground surface, there is provided, a pair of rear wheels supported at a rear end of the sweeper body, a pair of front wheels, and an axle apparatus supporting the pair of front wheels at a forward end of the sweeper body, the axle apparatus constructed to provide a space between the front wheels such that the suction hose extends through the space between the front wheels.

Advantageously, the axle includes axle members which leave a space between the front wheels of the vehicle. The suction hose passes through this space between the front wheels of the vehicle for desirable positioning of the nozzle of the suction hose without imparting a bend in the hose. This allows the suction hose to pass between the wheels, where the axle is located in prior art vehicles, permitting the hose to connect the nozzle and the container without overly compromising cab space in the vehicle, wheelbase or ride comfort.

BRIEF DESCRIPTION OF THE DRAWINGS

The present invention will be better understood with reference to the drawings, and the following description, in which.

DETAILED DESCRIPTION OF THE PREFERRED EMBODIMENTS

Figure 1A:
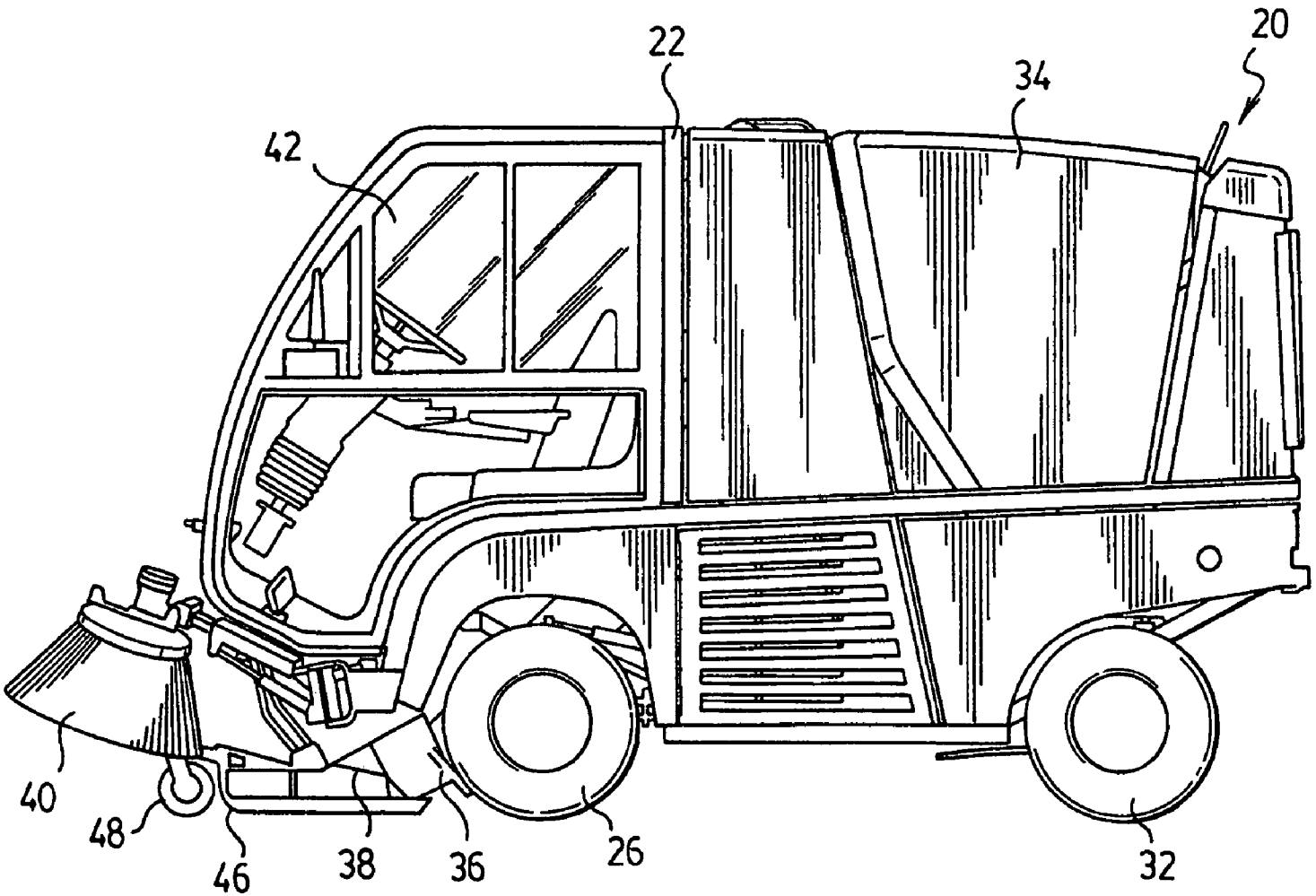
FIG. 1A is a side view of a vacuum sweeper vehicle according to a preferred embodiment of the present invention.
Figure 1B:
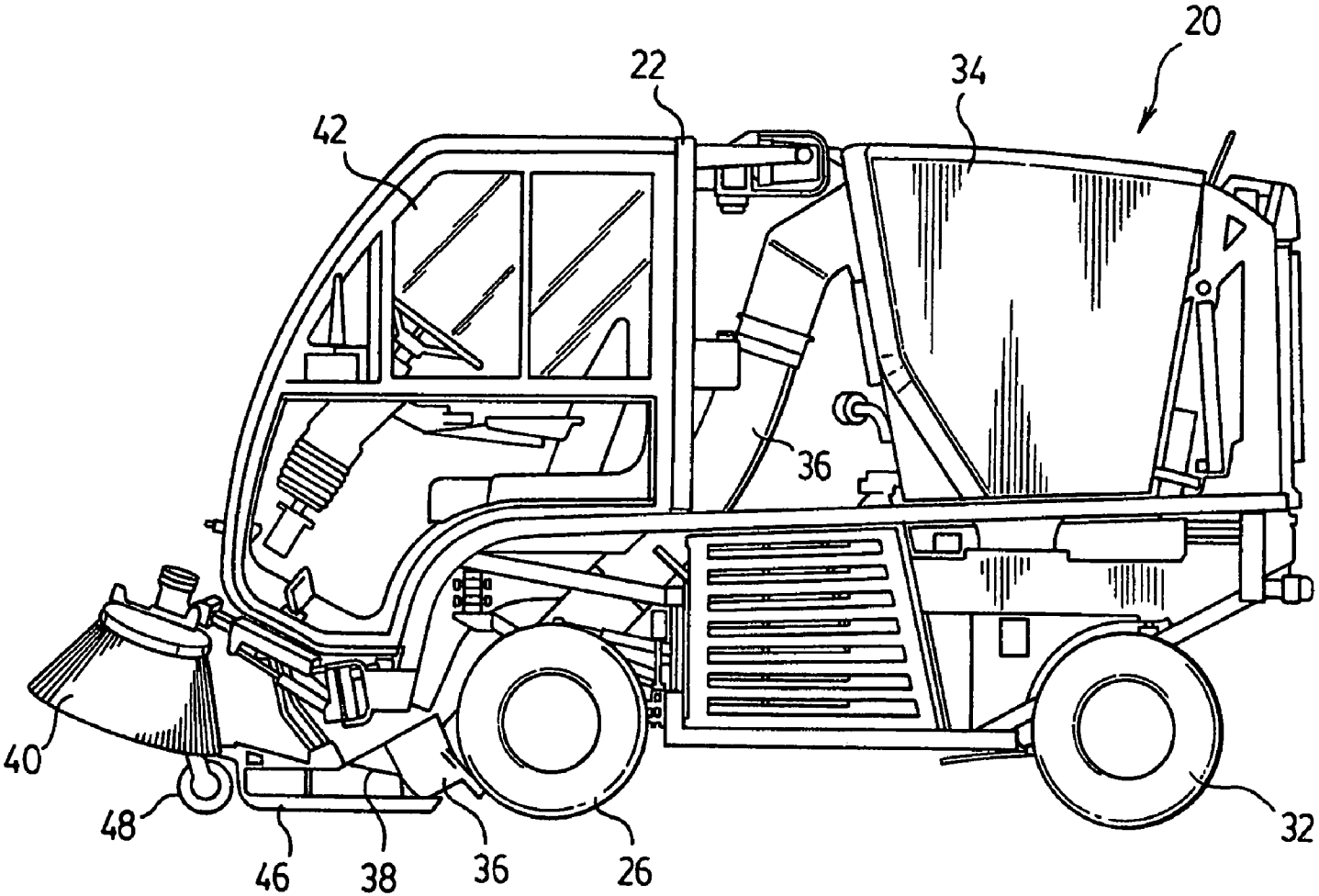
FIG. 1B is a side view of the vacuum sweeper vehicle of FIG. 1A, with cover portions of the vehicle removed to show a vacuum hose.
Figure 1C:
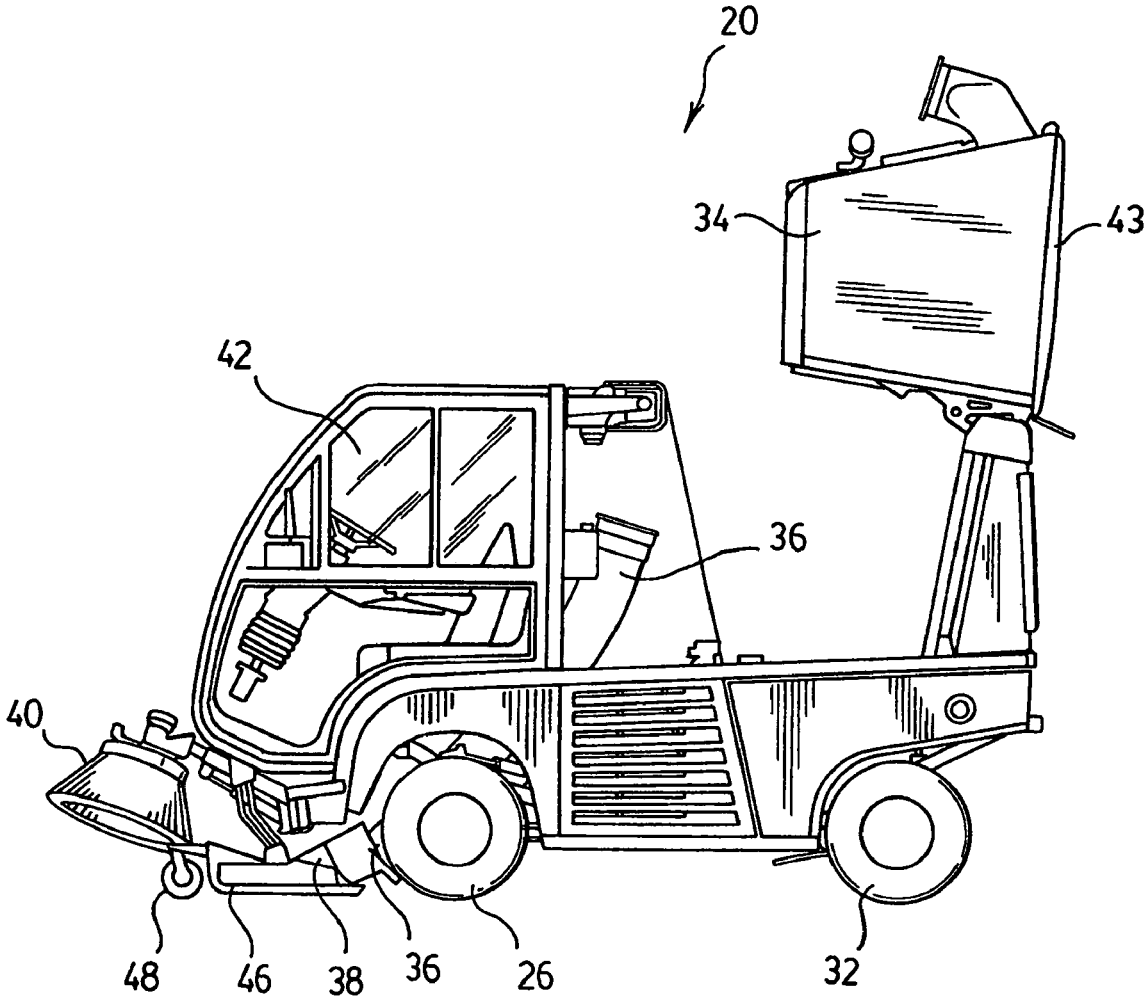
FIG. 1C is a side view of the vacuum sweeper vehicle of FIG. 1A, with a cover portion of the vehicle removed and showing a container of the vehicle in an emptying position.

Reference is first made to FIGS. 1A to 1C and 2 to describe a preferred embodiment of a vacuum sweeper vehicle designated generally by the numeral 20. The vacuum sweeper vehicle 20 has a sweeper body 22 including a frame 24 (best shown in FIG. 2). A pair of front wheels 26 are supported by an axle apparatus indicated generally by the numeral 28, at a forward end of the sweeper body 22. The axle apparatus is constructed to provide a space between the front wheels 26. A pair of rear wheels 32 are supported at a rearward end of the sweeper body 22. A container 34 is coupled to the sweeper body 22 for receiving debris. A suction hose 36 extends between the container 34 and a vacuum nozzle 38 proximal a forward end of the body 22. A suction device draws the debris from the nozzle 38, into the container 34, and a brush 40 coupled to a forward end of the sweeper body 22 sweeps debris from a ground surface.

The vacuum sweeper vehicle 20 will now be described in more detail. As shown in FIGS. 1A to 1C and 2, the vacuum sweeper vehicle 20 consists of the body 22 and the frame 24. The frame 24 is supported on a pair of front wheels 26 and a pair of rear wheels 32. An operator cab 42 is located in the body 22, at a forward end of the vacuum sweeper vehicle 20. Clearly the operator cab 42 includes an operator seat and controls for driving and operating the vacuum and sweeping functions of the vehicle 20.

The vehicle 20 includes vacuum components for drawing debris from the ground surface, such as a road, walkway, or other suitable surface. The vacuum components include the nozzle 38, the suction hose 36, the container 34 and a fan (not shown) for providing suction. The container 34 is located behind the operator cab 42, is secured to the frame 24, and includes a lift and tilt mechanism to move the container between a debris collecting position shown in FIG. 1A and an emptying position, shown in FIG. 1C. A top door 43 is hinged for opening and emptying of the container 34.

In one embodiment, the container 34 includes a perforated basket which supports an air permeable bag therein. The air permeable bag receives dirt and debris from the suction hose 36. Suction is provided by an engine-powered fan in the rear of the vehicle 20 and a filter surrounds the basket for filtering fine dust. A suitable filtration system including an air permeable bag, is described in U.S. Pat. No. 6,041,471 to Charky et al, which issued Mar. 28, 2000, the entire content of which is incorporated herein by reference.

Figure 2:
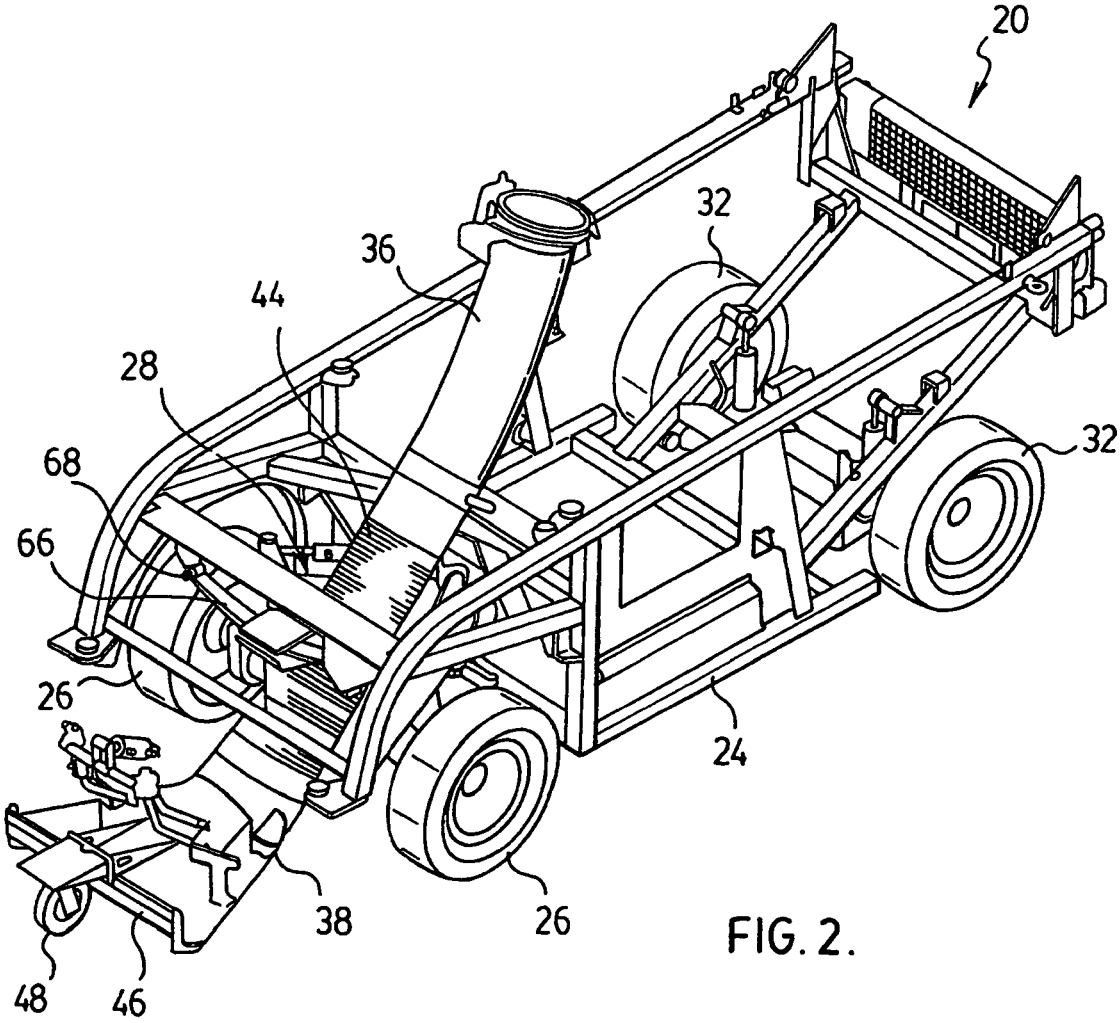
FIG. 2 is a perspective view of the vacuum sweeper vehicle of FIG. 1A, with a portion of a sweeper body removed, showing a sweeper frame.

The container 34 is connected to the suction hose 36 that extends generally vertically downwardly between the front wheels 26, to the vacuum nozzle 38. As best shown in FIG. 2, the suction hose 36 includes a flexible portion 44 which extends to the nozzle 38, for flexing during operation of the vacuum sweeper vehicle 20. The nozzle 38 is connected to a nozzle roller apparatus 46 that includes a wheel 48. Clearly, the nozzle roller apparatus 46, including the wheel 48, travels along the surface being cleaned by the vacuum sweeper vehicle 20, ahead of the vacuum sweeper vehicle 20. The nozzle roller apparatus 46 in combination with the flexible portion 44 of the suction hose 36 permits the vacuum nozzle 38 to travel very close to the surface while inhibiting the vacuum nozzle 38 from touching or scraping the surface as the vehicle 20 travels along.

The brush 40 is located at a forward end of the sweeper body, for sweeping debris from the ground surface. Clearly, the brush 40 rotates to sweep debris towards the vacuum nozzle 38 of the sweeper for drawing debris into the vacuum nozzle 38, through the suction hose 36 and into the container 34. The brush 40 includes a water spray system (not shown) for spraying water to inhibit the spread of dust during sweeping. Water is supplied by water tanks (not shown) fixed to the vehicle 20.

Figure 3:
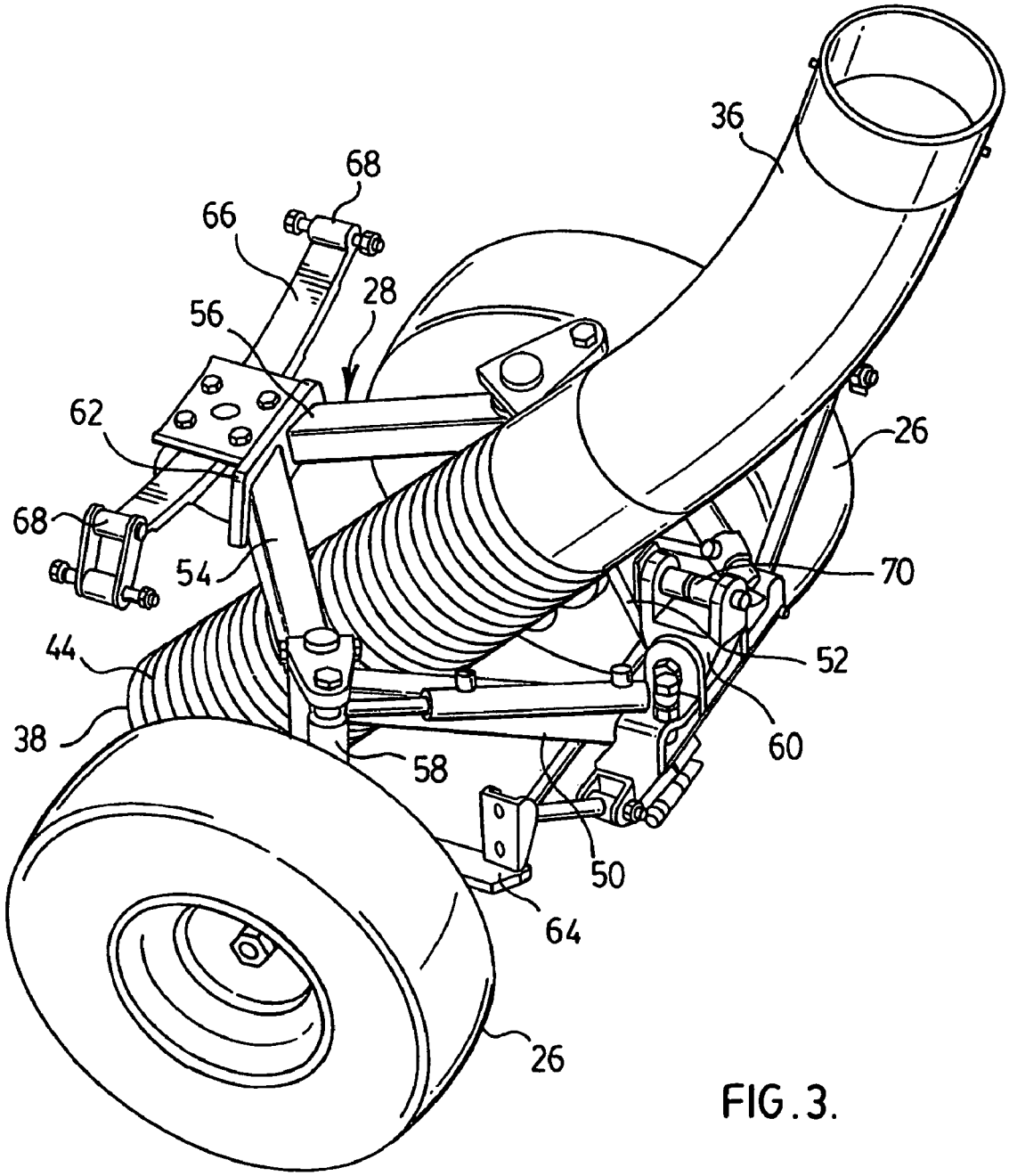
FIG. 3 is a perspective view of a portion of the vacuum sweeper vehicle of FIG. 1A.
Figure 4:
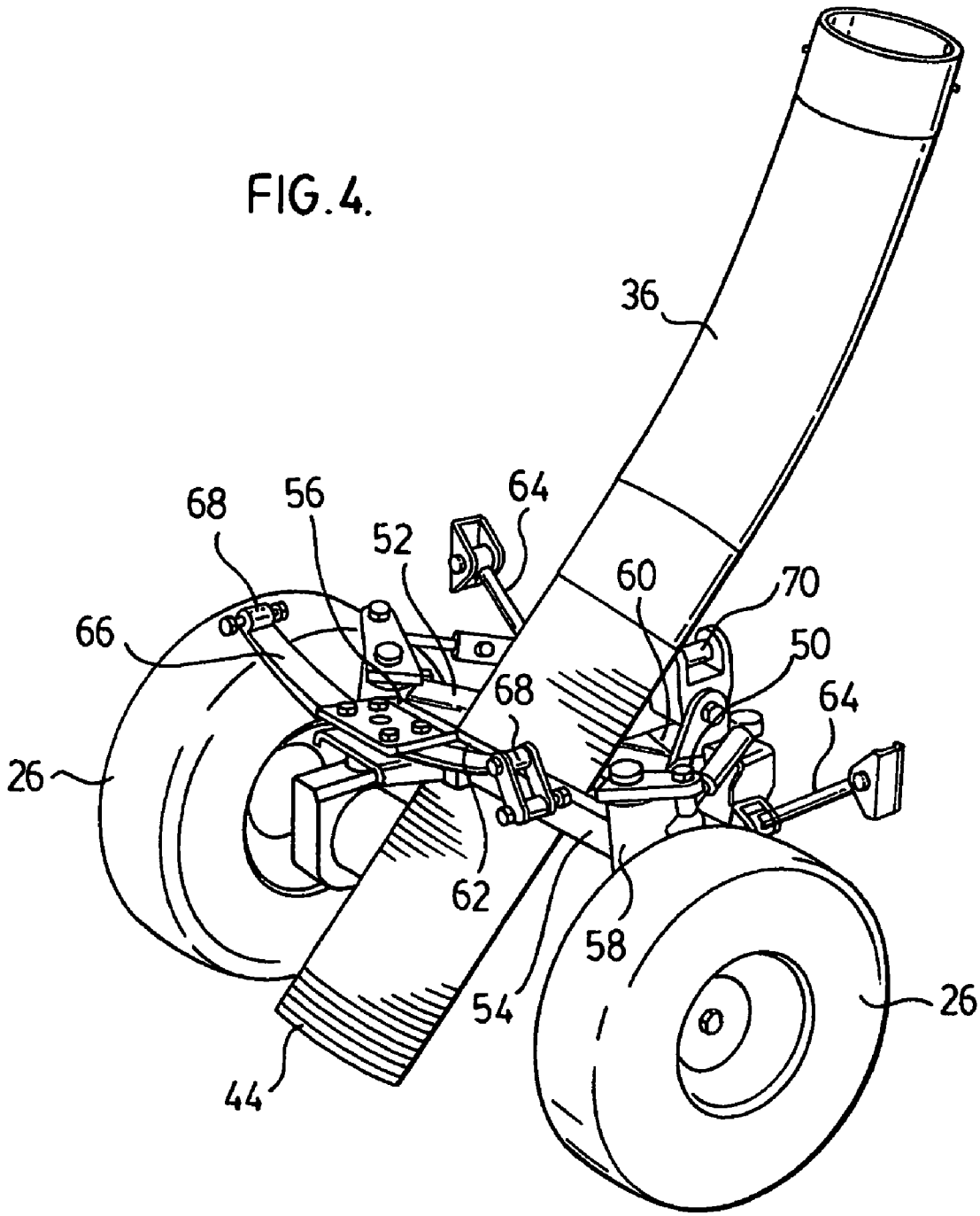
FIG. 4 is an alternative perspective view of the portion of the vacuum sweeper vehicle of FIG. 3.
Figure 5:
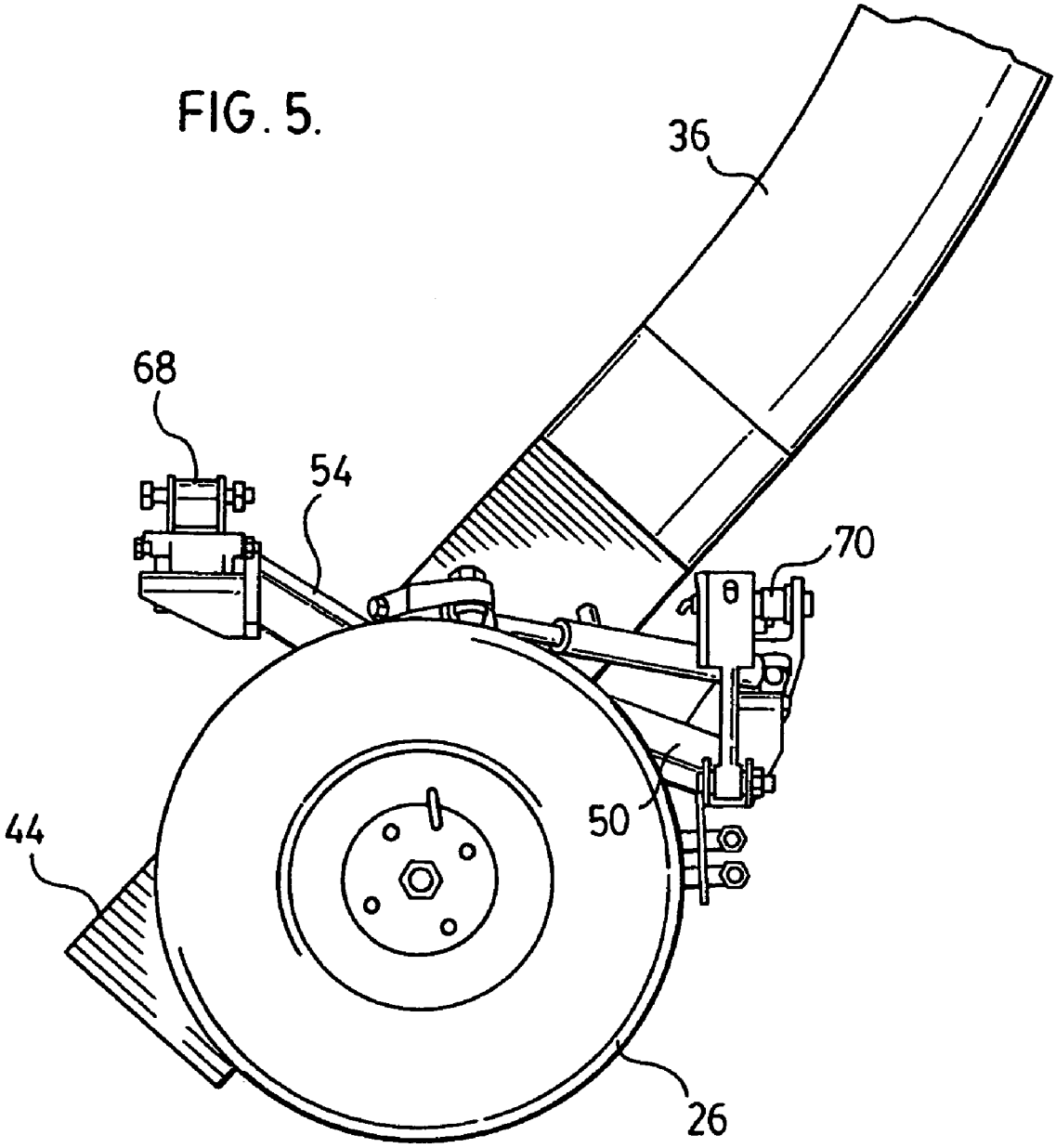
FIG. 5 is a side view of the portion of the vacuum sweeper vehicle of FIG. 3.

Reference is now made to FIGS. 3 to 5 to describe a portion of the mobile vacuum sweeper vehicle 20. In particular, rather than a conventional wheel axle, the front wheels 26 of the sweeper vehicle 20 are supported by the axle apparatus indicated generally by the numeral 28. The axle apparatus 28 is constructed to provide a space between the front wheels. In the present discussion, the terms left and right are used to describe parts of the axle apparatus 28 for the purpose of clarity only. The axle apparatus 28 includes a left rear axle member 50, a right rear axle member 52, a left forward axle member 54 and a right forward axle member 56. As shown in the FIGURES. each of the front wheels 26 are connected to a wheel support 58 and each wheel support 58 is, in turn, connected to a respective forward and a respective rear axle member.

In particular, the left wheel support 58 is connected to the left rear axle member 50, which extends generally rearward and to the right. Similarly, the right wheel support 58 is connected to the right rear axle member 52, which extends generally rearward and to the left. Clearly the left rear axle member 50 and the right rear axle member 52 extend towards each other and are connected together by an intermediate bar 60, thereby forming an elbow at the connection. The left rear axle member 50 and the right rear axle member 52 define an included angle which, in the present embodiment, is less than 90 degrees.

The left wheel support 58 is also connected to the left forward axle member 54, which extends generally forward and to the right. Similarly, the right wheel support 58 is connected to the right forward axle member 56, which extends generally forward and to the right. Clearly the left forward axle member 54 and the right forward axle member 56 extend towards each other and are connected together by an intermediate bar 62, thereby forming a second elbow at the connection. The left forward axle member 54 and the right forward axle member 56 define an included angle that, in the present embodiment, is approximately 90 degrees.

All of the axle members 50, 52, 54, 56 together form a space between the wheels, through which the flexible portion 44 of the suction hose 36 extends. In the present embodiment, the axle members 50, 52, 54, 56 together form a quadrilateral and leave the free space between the wheels 26, through which extends the flexible portion 44 of the suction hose 36.

The axle apparatus 28 also includes a leaf spring 66 projecting from the intermediate bar 62 connecting the forward axle members 54, 56. The leaf spring 66 is connected to the intermediate bar 62 at a middle portion of the leaf spring 66, and includes a connector 68 at each end thereof for connecting to each side of the frame 24 of the sweeper body 22, at a forward end thereof. Thus, the leaf spring 66 is positioned on the axle apparatus 28 and is therefore spaced forward of an axis between the two wheels 26. The position of the leaf spring 66 on the intermediate bar 62, spaced from the axis between the wheels 26 improves the braking reaction of the vehicle. The rear of the axle apparatus 28 also includes a connector 70 on the intermediate bar 60 connecting the rearward axle members 50, 52.

Clearly, each wheel includes steering linkage including, for example, linkage arm 64, as well as other components such as springs and shock absorbers. The details of steering linkage and other components, including their operation is well understood by those skilled in the art and need not be further described herein.

In use, the operator drives the vacuum sweeper vehicle 20 and controls the vacuum and sweeping functions from the operator cab 42. As the vehicle 20 drives along a surface, such as a road, debris is swept from the road by the brush 40 and is drawn into the vacuum nozzle 38 that is located near the road surface, on roller apparatus 46. The debris passes up through the suction hose 36 that extends through the axle members 50, 52, 54, 56, and is deposited into the container 34.

The location of the suction hose 36 between the axle members 50, 52, 54, 56, permits positioning of the vacuum nozzle 38, forward of the vehicle 20, without unduly comprising cab space in the vehicle. Also, it is clear that the wheelbase (the distance between the center of the rear wheels 32 and the center of the front wheels 26) is not changed to accommodate the suction hose 36. The position of the leaf spring 66 on the intermediate bar 62, spaced from the axis between the wheels 26 improves the braking reaction of the vehicle. In conventional vehicles, braking causes the front of the vehicle to dip downwardly. The movement of the leaf spring 66 to the position described, causes the braking reaction to be changed such that the front of the vehicle tends to rise during braking, providing an improved ride for the operator.

The many features and advantages of the present invention are apparent from the detailed specification. Since numerous modifications and changes may occur to those skilled in the art, it is not desired to limit the invention to the exact construction and operation illustrated and described herein. Accordingly, such modifications and changes are believed to be within the scope and sphere of the present invention.

What is claimed is:

1. A vacuum sweeper vehicle comprising:

a sweeper body including a frame having attached thereto an axle apparatus;

a pair of steerable front wheels supported by said axle apparatus at a forward end of said sweeper body, the axle apparatus comprising a plurality of axle members arranged to surround and define a space between said front wheels;

a pair of rear wheels supported at a rearward end of said sweeper body;

a container coupled to said sweeper body for receiving debris;

a suction hose extending between said container and a vacuum nozzle proximal the forward end of said sweeper body, said suction hose extending through said space between said front wheels;

a suction device for drawing said debris from said nozzle, into said container; and at least one brush coupled to the forward end of said sweeper body for sweeping debris from a ground surface.

2. The vacuum sweeper vehicle according to claim 1, wherein said plurality of axle members comprises at least a pair of axle members defining an elbow.

3. The vacuum sweeper vehicle according to claim 1, wherein said plurality of axle members comprises at least a pair of axle members defining an elbow such that the axle members form an included angle with respect to each other.

4. The vacuum sweeper vehicle according to claim 1, wherein said plurality of axle members comprises a pair of rear axle members and a pair of forward axle members, the pairs of axle members constructed to surround and define said space between the wheels.

5. The vacuum sweeper vehicle according to claim 4, wherein said axle members form a polygonal axle apparatus around said space between the wheels.

6. The vacuum sweeper vehicle according to claim 5, wherein said polygon is a quadrilateral.

7. The vacuum sweeper vehicle according to claim 4, further comprising a leaf spring connected between the pair of forward axle members and a front portion of the sweeper vehicle.

8. The vacuum sweeper vehicle according to claim 7, wherein said leaf spring in connected at a center portion thereof to said forward axle members and is connected at each end to the front portion of the sweeper vehicle.

9. The vacuum sweeper vehicle according to claim 1, wherein said nozzle is supported on a roller apparatus for rolling said nozzle proximal the ground surface.

10. The vacuum sweeper vehicle according to claim 9, wherein said roller apparatus extends forward to said sweeper body.

11. The vacuum sweeper vehicle according to claim 1, further comprising an operator's cab at said forward end of said sweeper body.

12. In a vacuum sweeper vehicle having a sweeper body including a frame, a container coupled to the sweeper body for receiving debris, a suction hose extending between a vacuum nozzle proximal a forward end of the body and said container, a suction device for drawing debris from the nozzle into the container, at least one brush connected to a forward end of the sweeper body for sweeping debris from a ground surface, a pair of rear wheels supported at a rear end of said sweeper body, and a pair of steerable front wheels;

the improvement comprising an axle apparatus attached to said frame, said axle apparatus supporting said pair of front wheels at the forward end of said sweeper body, the axle apparatus comprising a plurality of axle members arranged to surround and define a space between said front wheels whereby said suction hose extends through said space between said front wheels.

13. The vacuum sweeper vehicle according to claim 12, wherein said plurality of axle members comprises at least a pair of axle members defining an elbow such that the axle members form an included angle with respect to each other.

14. The vacuum sweeper vehicle according to claim 12, wherein said plurality of axle members comprises a pair of rear axle members and a pair of forward axle members, the pairs of axle members constructed to surround and define said space between the wheels.

15. The vacuum sweeper vehicle according to claim 14, wherein said axle members form a polygonal axle apparatus around said space between the wheels.

16. The vacuum sweeper vehicle according to claim 14, further comprising a leaf spring connected between the pair of forward axle members and a front portion of the sweeper vehicle.

17. The vacuum sweeper vehicle according to claim 16, wherein said leaf spring is connected at a center portion thereof to said forward axle members and is connected at each end to a front portion of the sweeper vehicle.

18. The vacuum sweeper vehicle according to claim 16, wherein said leaf spring is connected at a center portion thereof to said forward axle members and is connected at each end to a front portion of the sweeper vehicle.

19. The vacuum sweeper vehicle according to claim 14, wherein said axle members form a polygonal axle apparatus around said space between the wheels.

20. The vacuum sweeper vehicle according to claim 14, further comprising a leaf spring connected between a pair of forward axle members and the front portion of the sweeper vehicle.

21. The vacuum sweeper vehicle according to claim 12, further comprising an operator's cab at said forward end of said sweeper body.

22. The vacuum sweeper vehicle according to claim 12, wherein said plurality of axle members comprises a pair of rear axle members and a pair of forward axle members, the pairs of axle members constructed to surround and define said space between the wheels.

23. The vacuum sweeper vehicle according to claim 12, further comprising an operator's cab at said forward end of said sweeper body.

24. A vacuum sweeper vehicle comprising:

a sweeper body including a frame;

a pair of front wheels supported by an axle apparatus at a forward end of said sweeper body, the axle apparatus comprising a plurality of axle members arranged to surround and define a space between said front wheels, the axle apparatus comprising at least one axle member defining an elbow;

a pair of rear wheels supported at a rearward end of said sweeper body;

a container coupled to said sweeper body for receiving debris;

a suction hose extending between said container and a vacuum nozzle proximal the forward end of said sweeper body, said suction hose extending through said space between said front wheels;

a suction device for drawing said debris from said nozzle, into said container; and at least one brush coupled to the forward end of said sweeper body for sweeping debris from a ground surface.

25. The vacuum sweeper vehicle according to claim 24, wherein said plurality of axle members comprises at least a pair of axle members defining said elbow such that the axle members form an included angle with respect to each other.

26. The vacuum sweeper vehicle according to claim 24, wherein said plurality of axle members comprises a pair of rear axle members and a pair of forward axle members, the pairs of axle members constructed to surround and define said space between the wheels.

27. The vacuum sweeper vehicle according to claim 26, wherein said axle members form a polygonal axle apparatus around said space between the wheels.

28. The vacuum sweeper vehicle according to claim 27, wherein said polygon is a quadrilateral.

29. The vacuum sweeper vehicle according to claim 26, further comprising a leaf spring connected between the pair of forward axle members and a front portion of the sweeper vehicle.

30. The vacuum sweeper vehicle according to claim 29, wherein said leaf spring in connected at a center portion thereof to said forward axle members and is connected at each end to the front portion of the sweeper vehicle.

31. The vacuum sweeper vehicle according to claim 24, wherein said nozzle is supported on a roller apparatus for rolling said nozzle proximal the ground surface.

32. The vacuum sweeper vehicle according to claim 24, wherein said roller apparatus extends forward to said sweeper body.

33. The vacuum sweeper vehicle according to claim 24, further comprising an operator's cab at said forward end of said sweeper body.

34. In a vacuum sweeper vehicle having a sweeper body, a container coupled to the sweeper body for receiving debris, a suction hose extending between a vacuum nozzle proximal a forward end of the body and said container, a suction device for drawing debris from the nozzle into the container, and at least one brush connected to a forward end of the sweeper body for sweeping debris from a ground surface, a pair of rear wheels supported at a rear end of said sweeper body, and a pair of front wheels;

the improvement comprising an axle apparatus supporting said pair of front wheels at the forward end of said sweeper body, the axle apparatus comprising a plurality of axle members arranged to surround and define a space between said front wheels whereby said suction hose extends through said space between said front wheels, wherein said axle apparatus comprises at least one axle members defining an elbow such that the axle member forms an included angle.

* * * * *